US005951264A

United States Patent [19]

Hori et al.

[11] Patent Number: 5,951,264

[45] Date of Patent: Sep. 14, 1999

[54] STRUCTURE FOR MOUNTING A WATER PUMP, WATER PUMP, AND COOLING SYSTEM

[75] Inventors: Yoshiaki Hori; Hiromi Sumi, both of Wako, Japan

[73] Assignee: Honda Giken Kogyo Kabushiki Kaisha, Tokyo, Japan

[21] Appl. No.: 08/842,786

[22] Filed: Apr. 16, 1997

[30] Foreign Application Priority Data

Apr. 16, 1996 [JP] Japan ..... 8-094439

[51] Int. Cl.[6] ..... F04B 17/00

[52] U.S. Cl. ..... 417/360; 417/362; 417/364

[58] Field of Search ..... 417/360, 362, 417/364

[56] References Cited

U.S. PATENT DOCUMENTS 3,153,388 10/1964 Cheely ..... 417/362
3,756,751 9/1973 Holmes ..... 417/364
4,272,224 6/1981 Kable ..... 417/360

FOREIGN PATENT DOCUMENTS 62-179323 11/1987 Japan .

*Primary Examiner*—Charles G. Freay

[57] ABSTRACT

A structure for mounting a water pump to a water-cooled internal combustion engine in an easy manner. A water-cooled internal combustion engine in which the water pump is removably mounted to a side wall of the water-cooled internal combustion engine, is driven by power transmitted from a crank shaft to the water pump through a transmission mechanism, wherein a water pump driving member is arranged closer to a center of the internal combustion engine than an output driving member of the crank shaft. A water pump following member is driven by accepting the power from the water pump driving member and is rotatably mounted to a side wall of the internal combustion engine. A drive shaft of the water pump is removably spline fitted to splined aperture of the water pump following member.

14 Claims, 10 Drawing Sheets

STRUCTURE FOR MOUNTING A WATER PUMP, WATER PUMP, AND COOLING SYSTEM

BACKGROUND OF THE INVENTION

1. Technical Field of the Invention

This invention relates to a structure for mounting and to a water pump for a water-cooled internal combustion engine. More particularly, this invention relates to a structure for mounting and removing a water pump to and from a water-cooled internal combustion engine which may be installed on a small-sized vehicle such as a motorcycle. The invention also relates to a cooling system incorporating the inventive water pump.

2. Description of Related Art

Conventional water-cooled internal combustion engines for small-sized vehicles, such as Japanese Utility Model Laid-Open No. Sho 62-179323 that is illustrated in FIGS. 7 to 9, mount the water pump 03 to a pump fixing wall 04 that is formed at a right side wall of an upper cylinder block fixing part 02 of a crank case 01. A pump housing 05 for the water pump 03 is removably fixed to an outside part of the pump fixing wall 04.

In addition, the pump drive shaft 06 is rotatably mounted to the pump fixing wall 04 and a pump rotor 07 is removably installed at an outer end of the pump drive shaft 06. Further, a driven sprocket 08 is removably installed on an inner end of the pump drive shaft 06.

Further, an intermediate shaft 010 is arranged at an intermediate location between crank shaft 09 and the pump drive shaft 06. An inner end of the intermediate shaft 010 is rotationally mounted to the crank case 01 and an outer end of the intermediate shaft 010 is rotatably mounted to supporting member 011 which is removably fixed to the crank case 01.

The drive sprocket 012 and the driven sprocket 013 are integrally fitted to an inner side and an outer side of the intermediate shaft 010, respectively.

Further, an crank shaft output gear 014 is integrally fitted to the crank shaft 09 at an intermediate position axially between the drive sprocket 012 and a driven sprocket 013 of the intermediate shaft 010. A crank shaft drive sprocket 015 is integrally fitted to the crank shaft 09 and located outboard with respect to the crank shaft output gear 014.

A first chain 016 transmits power from the crank shaft drive sprocket 015 to the driven sprocket 013 of the intermediate shaft 010. A second chain 017 transmits power from the drive sprocket 012 of the intermediate shaft 010 to the driven sprocket 08 of the pump drive shaft 06. In this way, the crankshaft 09 drives the pump drive shaft 06 which, in turn, rotates the pump rotor 07.

In the conventional water-cooled internal combustion engine illustrated in FIGS. 7 to 9 and described above, the pump drive shaft 06 is rotatably mounted to the pump fixing wall 04 which is integral with the upper cylinder block fixing part 02. Furthermore, the driven sprocket 08 is installed inside the pump housing 05 and inside of the upper cylinder block fixing part 02.

With this conventional structure, even if the pump housing 05 is removed from the pump fixing wall 04, the pump drive shaft 06 and the pump rotor 07 could not be easily removed. The result is that removing the pump drive shaft 06 and the pump rotor 07 (which is necessary to replace the water pump) is impossible so long as the upper cylinder block fixing part 02 that is integral with the crank case 01 is not removed from the cylinder block (not shown) and so long as the driven sprocket 08 was not removed from the pump drive shaft 06. In other words, the conventional water pump structure 03 dictates disassembly of the driven sprocket 08, upper cylinder block fixing part 02, and crank case 01 to remove the pump drive shaft 06 and the pump rotor 07 and, eventually, the water pump 03.

Further complicating this disassembly procedure is that there is only a narrow space in the crank case 01 in which to disassemble and remove the driven sprocket 08 from the pump drive shaft 06. Assembling the conventional water pump 03 is also quite difficult and cumbersome for the same reasons.

Furthermore, maintenance and inspection of the water pump 03 could not easily be performed with the conventional structure.

SUMMARY OF THE INVENTION

This invention relates to improvements in a water-cooled internal combustion engine that may be used in, for example, a small-sized vehicle such as a motorcycle which overcomes the disadvantages described above.

This invention further relates to the water-cooled internal combustion engine in which a water pump is removably installed at a side wall of the water-cooled internal combustion engine.

This invention also provides a water pump structure wherein power is transmitted from a crank shaft to the water pump through a transmission mechanism wherein a water pump driving member is arranged axially closer to a central portion of the internal combustion engine than an output driving member of the crank shaft, a water pump following member (accepting power from the water pump driving member) is rotatably mounted at a side wall of the internal combustion engine, and a drive shaft of the water pump is removably spline fitted to a splined aperture of the water pump following member.

Due to the above construction, as a force is applied in a direction from the side wall of the water-cooled internal combustion engine to the water pump outwardly along a longitudinal direction of the drive shaft of the water pump, the water pump drive shaft that is spline fitted to the water pump following member can be easily pulled from the water pump following member.

Because the water pump following member is not pulled out along with the water pump driving member, the main body of the water pump can be easily and positively fixed and removed. Thus, it is possible to perform repairs, a maintenance and inspections of the water pump easily and efficiently.

In addition, in the present invention, because the water pump is rotatably mounted at the side wall of the internal combustion engine, it is possible to arrange the water pump near the side wall of the internal combustion engine and to make the entire internal combustion engine compact.

In addition, the water pump following member is prevented from being dropped from the side wall of the internal combustion engine when the water pump is removed because the water pump following member is rotatably supported at the side wall of the internal combustion engine and is engaged with the crank shaft output driving member (located outboard with respect to the water pump following member).

Additionally, the present invention permits construction of a water pump and cooling system with a reduced number of component parts and reduced cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS AND COOLING SYSTEM

Figure 1:
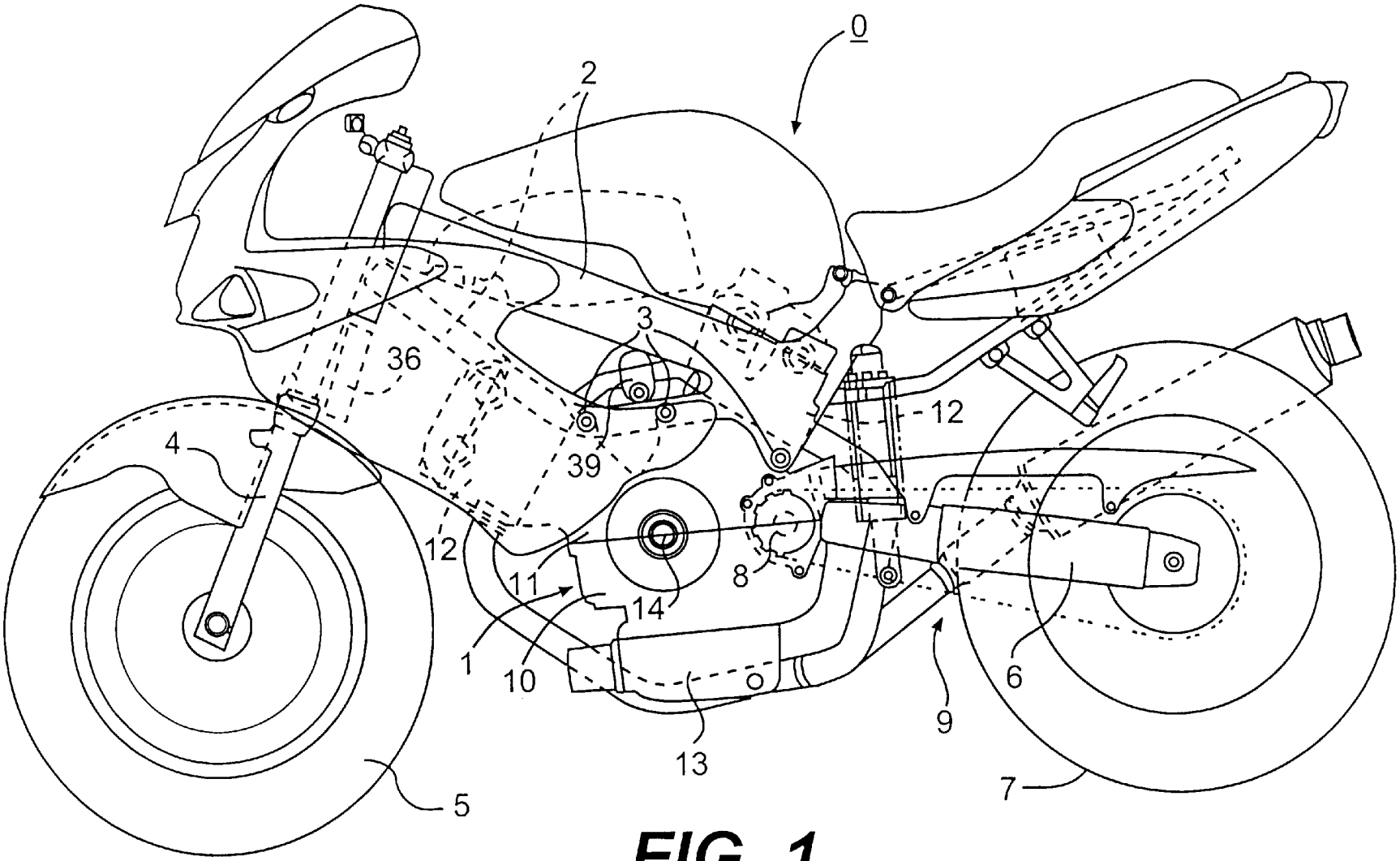
FIG. 1 is a left side elevational view showing a motorcycle having a water-cooled internal combustion engine with a water pump fixing structure of the present invention.

FIG. 1 generally shows a motorcycle which incorporates the water pump, water pump mounting structure, and cooling system of the invention.

Referring now to FIGS. 1 to 4, a preferred embodiment of the present invention will be described as follows.

A water-cooled 4-stroke internal combustion engine mounted on a motorcycle 0 may be a spark-ignition type forward or rearward V-shaped 2-cylinder internal combustion engine, wherein the water-cooled 4-stroke internal combustion engine 1 is removably fixed to the frame 2 of the motorcycle 0 with bolts-nuts 3.

In addition, a front fork 4 is arranged at a front end of the frame 2 of the motorcycle 0 in such a way that it may be turned right or left. A front wheel 5 is rotatably arranged at a lower end of the front fork 4. A rear wheel 7 is rotatably mounted to the rear end of the rear fork 6. An output shaft 8 of a transmission (not shown) located in the water-cooled 4-stroke internal combustion engine 1 and the rear wheel 7 are connected to each other through a chain transmission mechanism 9. Thus, the rear wheel 7 is rotationally driven with the power of water-cooled 4-stroke internal combustion engine 1.

Further, cylinder head 12 is securely mounted to the cylinder block 11 and oil pan 13 is fixed below the crank case 10. As the piston(s) (not shown) that are fitted into a cylinder bore formed in the cylinder block 11 reciprocate, a connecting rod translates this reciprocal motion into rotational motion of the crank shaft 14.

Figure 3:
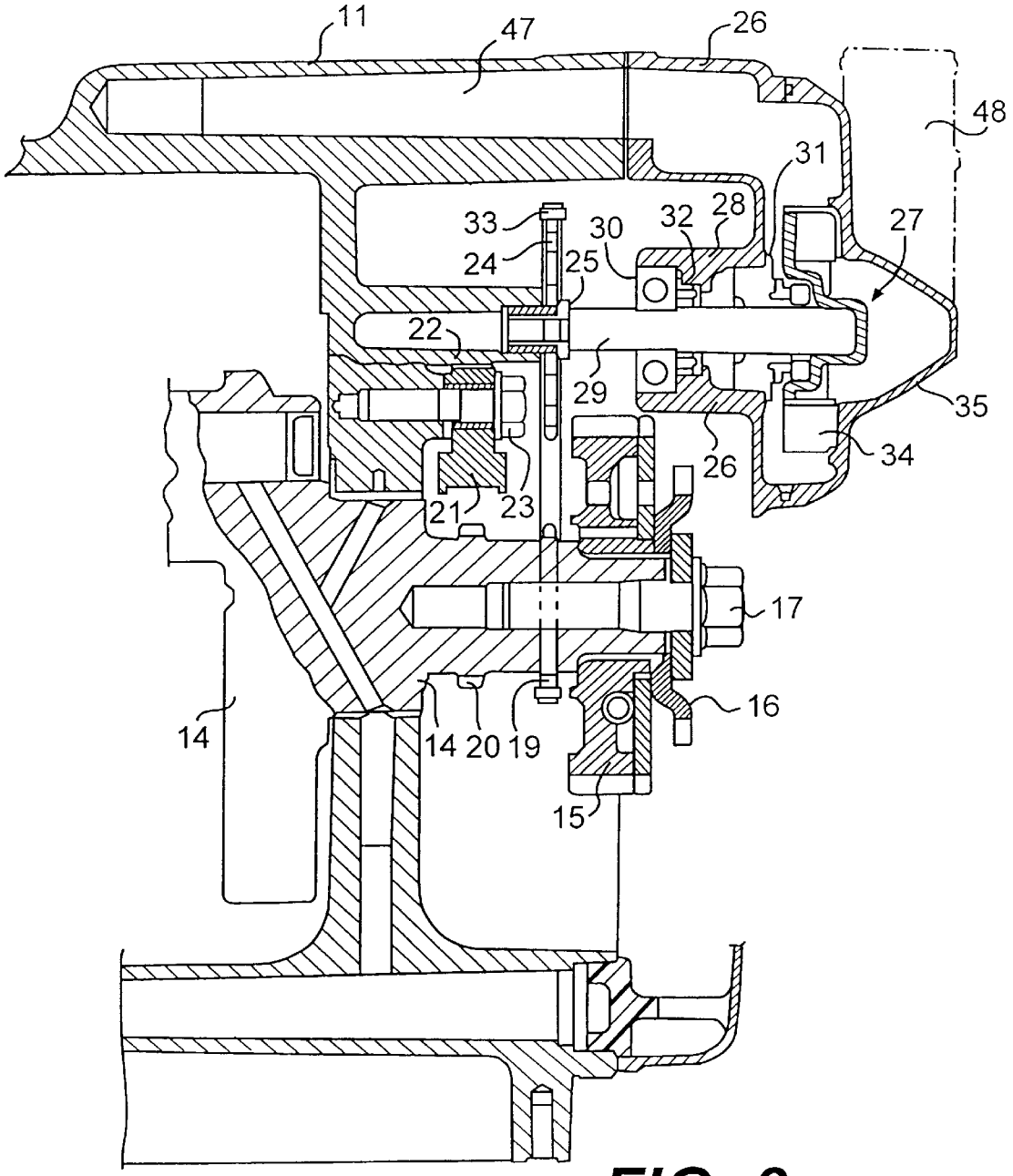
FIG. 3 is a cross-sectional view taken along section line III—III of FIG. 2.

Further, as shown in FIG. 3, an output gear 15 and a rotor 16 for detecting the ignition timing of an ignition coil (not shown) and for detecting a crank angle are fitted to the right end of the crank shaft 14. Still further, the output gear 15 and the rotor 16 are integrally fixed to the crank shaft 14 with a bolt 17 threadably fitted to the right (outboard) end of the crank shaft 14.

Figure 2:
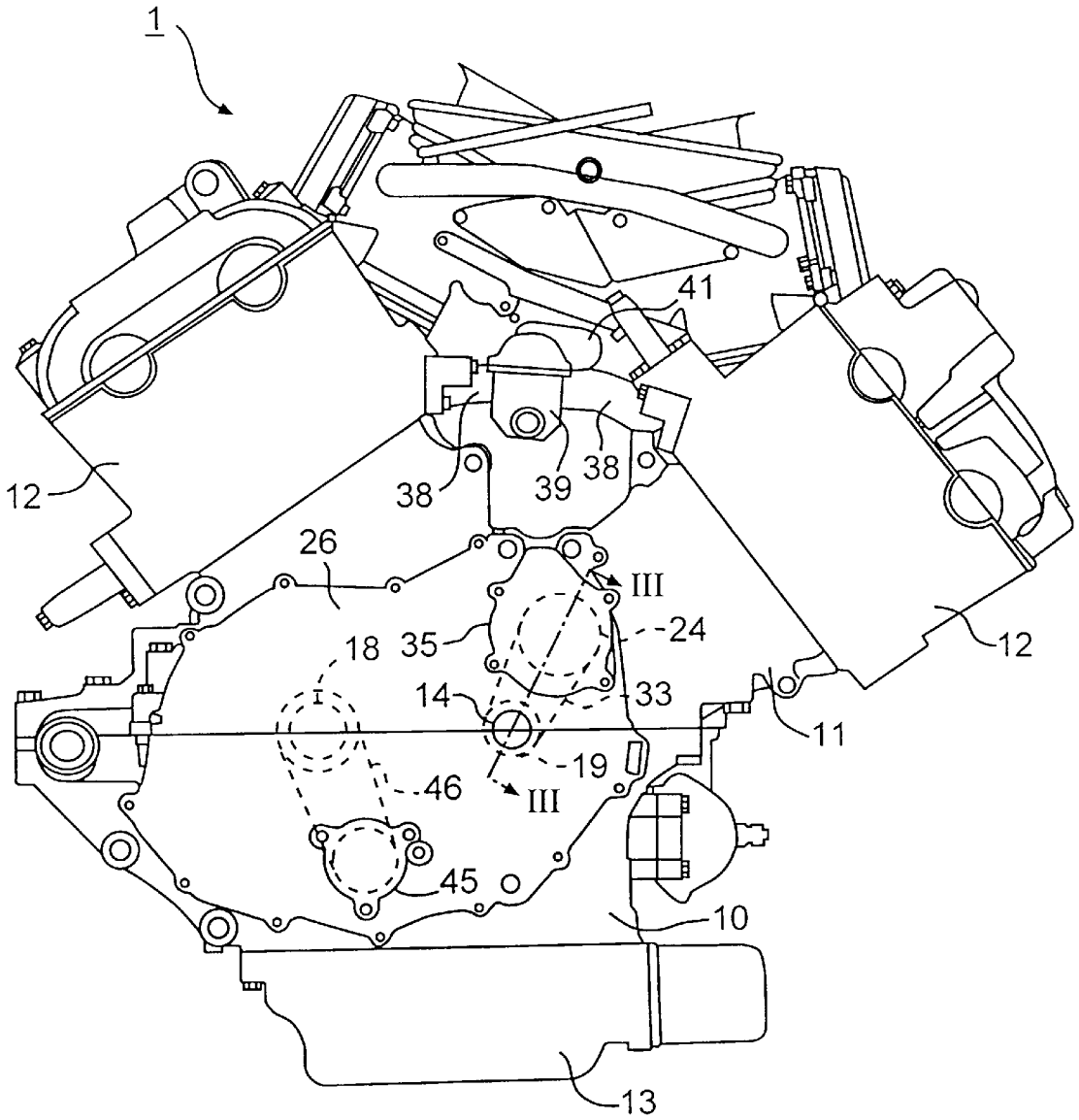
FIG. 2 is a right side elevational view showing large components of the water pump fixing structure of the present invention.

As shown in FIG. 2, a main shaft 18 is positioned to the rear of the crank shaft 14 and rotatably mounted to the crank case 10 and the cylinder block 11. An outer member of the clutch (not shown) is arranged at the main shaft 18 and threadably engaged with the output gear 15. Reduction gears (not shown) are installed at the main shaft 18 and the output shaft 8 such that when the water-cooled 4-stroke internal-combustion engine 1 is operating with the clutch engaged, the output shaft 8 is rotationally driven at a desired transmission ratio.

In addition, a water pump drive sprocket 19 acting as a water pump driving member and a valve train drive sprocket 20 of a dynamic valve train system (not shown) are positioned inboard with respect to the output gear 15 and are integrally formed in sequence (20,19,15,16) along the crank shaft 14. In other words, the water pump drive sprocket is axially arranged closer to a center of the internal combustion engine than an output gear 15.

The lower end of cam chain tensioner 21 is placed adjacent to the valve train drive sprocket 20 and is pivotably mounted on the cylinder block 11 by a bolt 23 and sleeve 22 to permit oscillation of the cam chain tensioner 21. A cam chain (not shown) wound around the valve train drive sprocket 20 is tensioned by the cam chain tensioner 21 to remove slack and maintain proper cam chain tension.

Further, a splined aperture 25 is connected to the water pump driven sprocket 24 and is rotatably mounted to the right side wall of the crank case 10 just above and forward of the crank shaft 14 (see FIG. 2).

Figure 4:
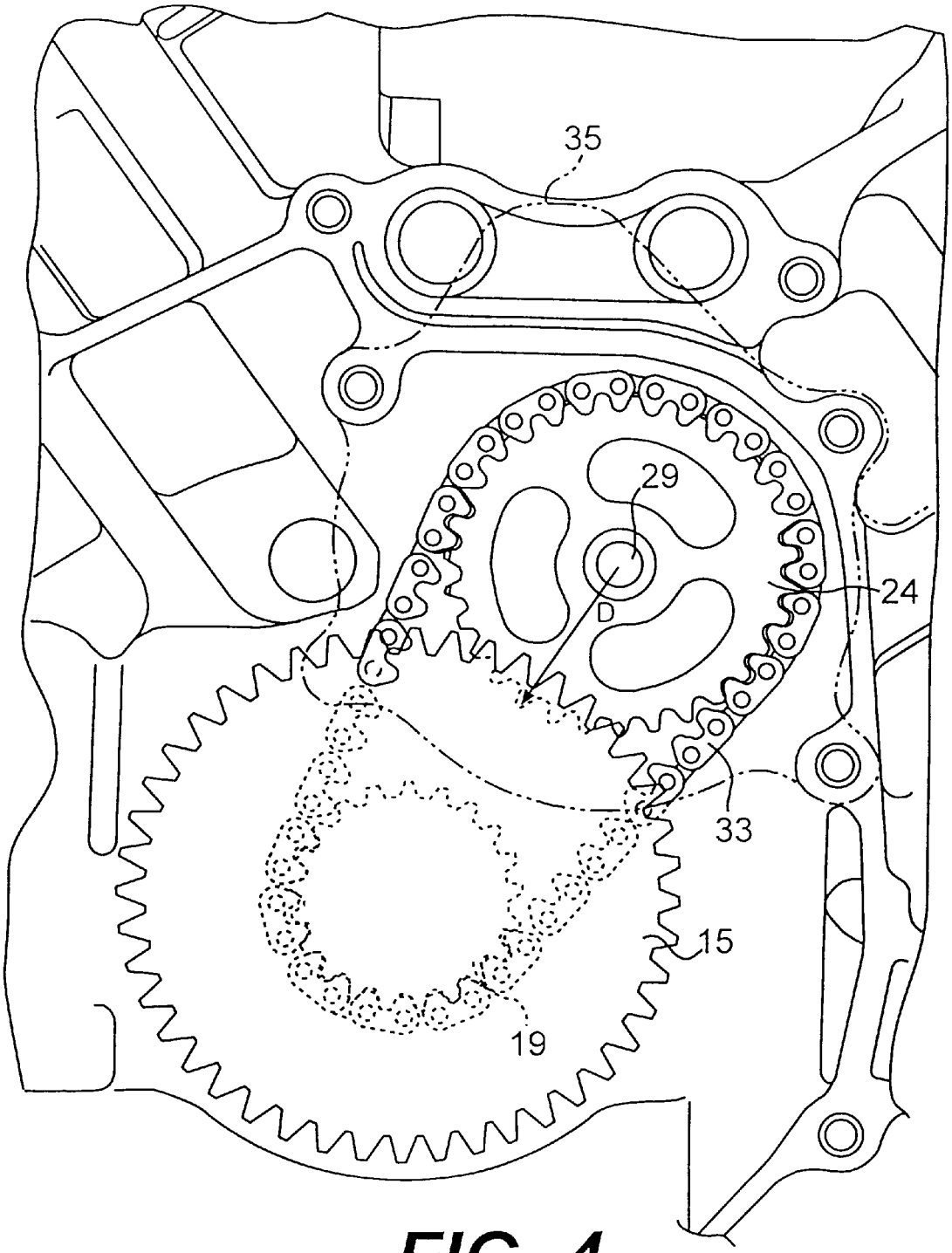
FIG. 4 is an enlarged view of FIG. 2 where a right side cover is removed.
Figure 5:
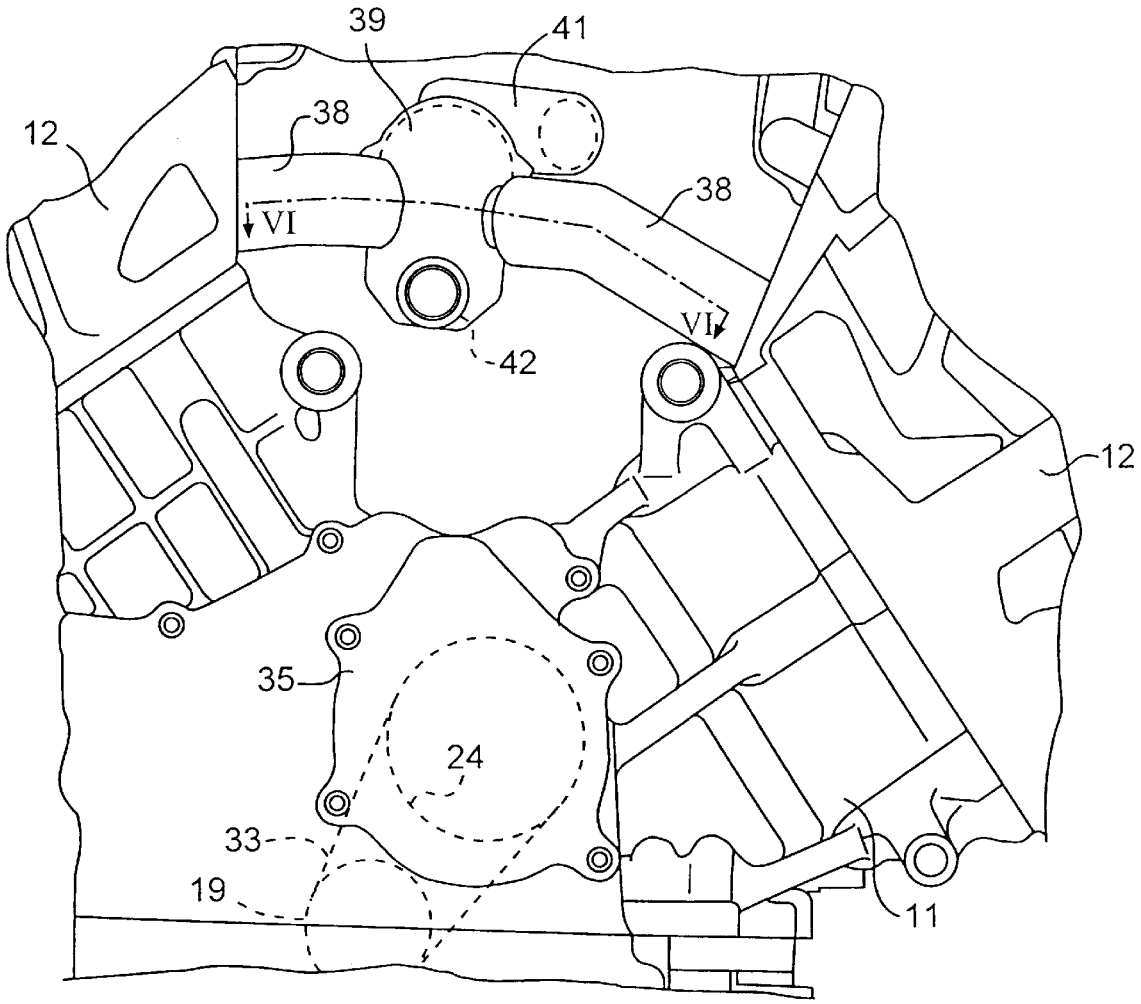
FIG. 5 is an enlarged view of FIG. 2 showing details of the invention from a side elevational view.

As further shown in FIG. 4, an outer diameter D of the water pump driven sprocket 24 is relatively large and projects toward a center of the output gear 15 and beyond (see shadow lines) the outer diameter of the output gear 15 as viewed from outside to inside along the pump drive shaft 29.

Furthermore, the output gear 15 is located outboard with respect to the water pump driven sprocket 24. Taken together, the outboard location of the output gear and the relatively larger diameter of the water pump driven sprocket 24 act to trap the water pump driven sprocket 24 such that it does not fall off the pump drive shaft 29 as the water pump 27 is disassembled.

The right-side cover 26 covering the crank case 10 and the right end of the cylinder block 11 is formed with a pump drive shaft supporting part 28 positioned outboard from the water pump driven sprocket 24. The pump drive shaft 29 of the water pump 27 is oil-water sealingly and rotatably mounted to the pump drive shaft supporting part 28 through a bearing 30 and seals 31, 32.

An inner end of the pump drive shaft 29 is spline fitted to the splined aperture 25 of the water pump driven sprocket 24.

An endless chain 33 is wound around the water pump drive sprocket 19 and the water pump driven sprocket 24.

Thus, as the crank shaft 14 is rotated, the pump drive shaft 29 is rotationally driven which drives the water pump driven sprocket 24.

Additionally, an impeller 34 of the water pump 27 is integrally fitted to an outer end of the pump drive shaft 29. An inter-pump space is formed by the right side cover 26 and a pump cover 35 removably fitted to the right side cover 26.

A suction port (not shown) of the water pump 27 is connected to the bottom part of the forward radiator 36 of the motorcycle 0 through a water hose 48 and concurrently the discharging port (not shown) of the water pump 27 is connected to the bottom part of a water jacket 47 formed at the cylinder block 11 and the cylinder head 12. In this way, the water cooled by the radiator 36 is supplied by the water pump 27 to the water jacket 47 of the crank case 10 and the cylinder block 11.

In other words, water that has been heated to a high temperature within the water jacket 47 of the water-cooled 4-stroke internal combustion engine 1 is supplied to the radiator 36 and cooled.

Figure 6:
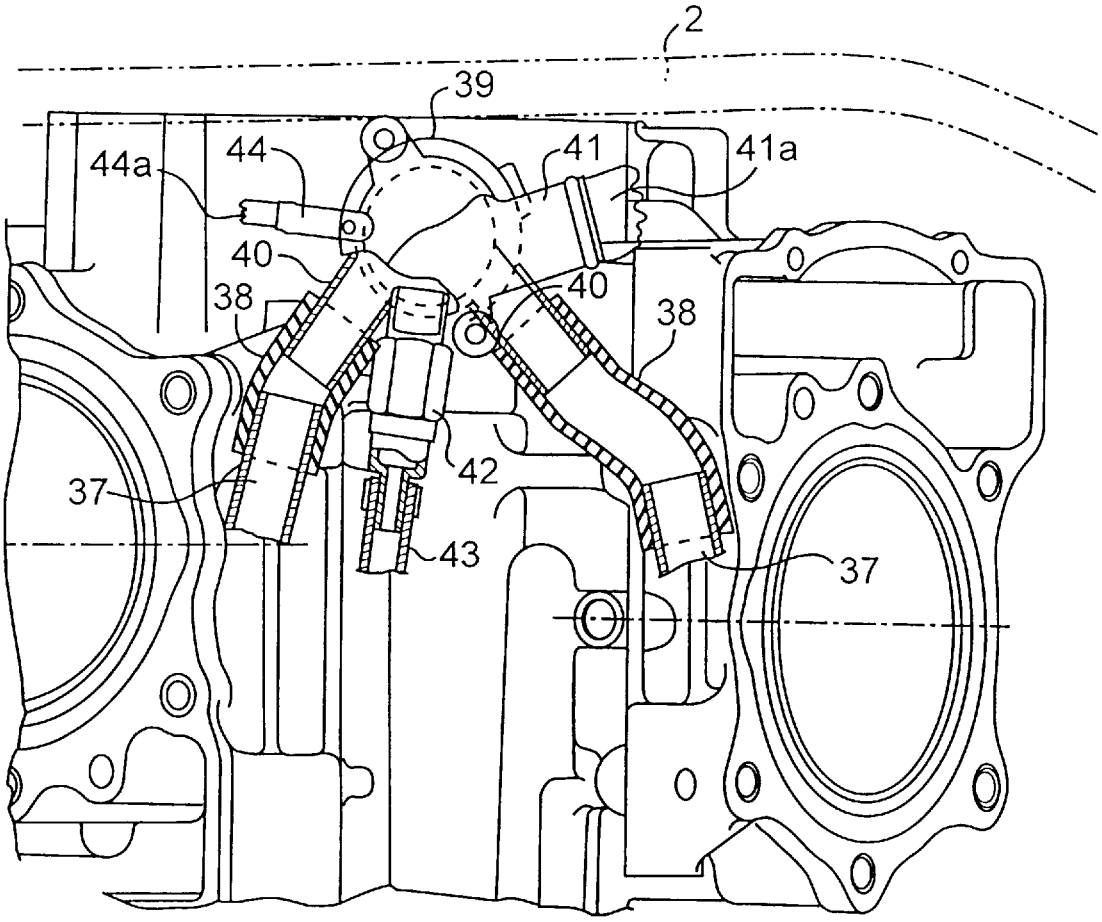
FIG. 6 is a top plan view and longitudinal partial cross-sectional view taken along cross-section line VI—VI of FIG. 5.
Figure 7:
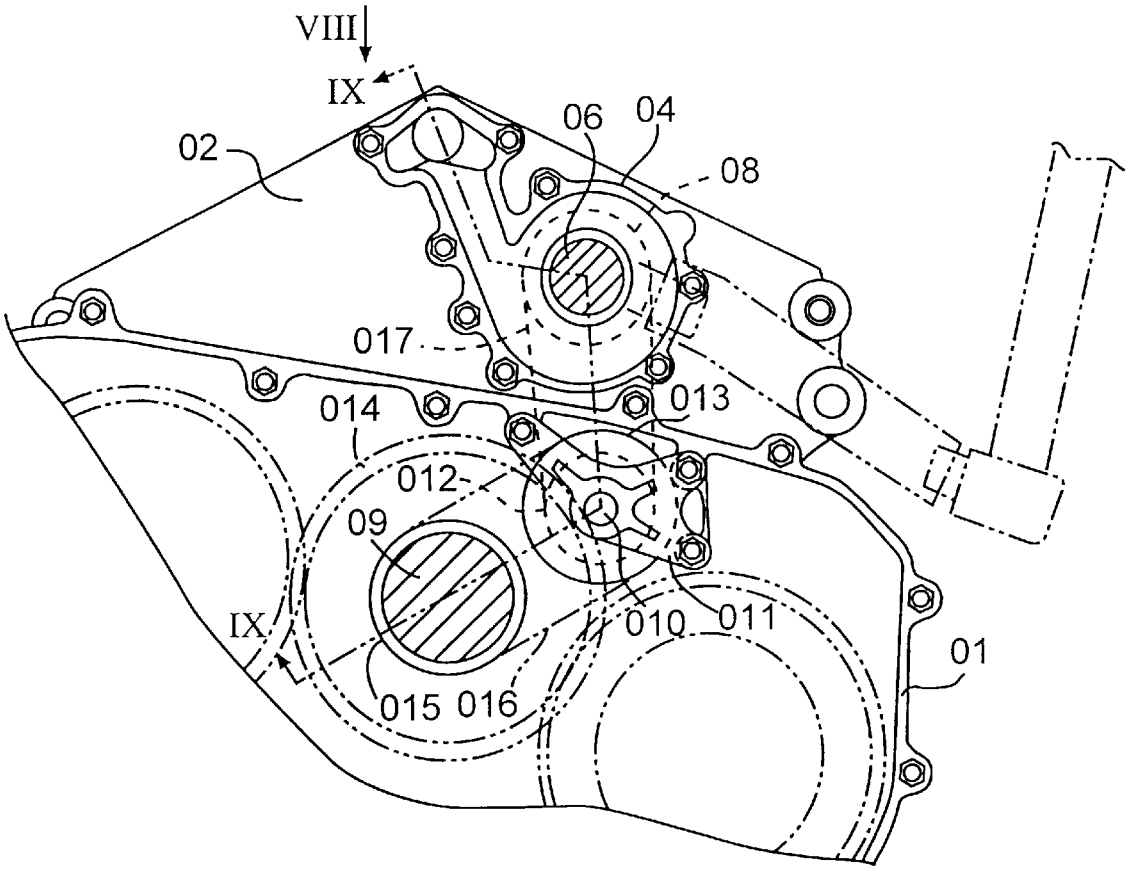
FIG. 7 CONVENTIONAL ART
FIG. 7 is a side elevational view of a substantial part of a conventional water-cooled internal combustion engine.
Figure 8:
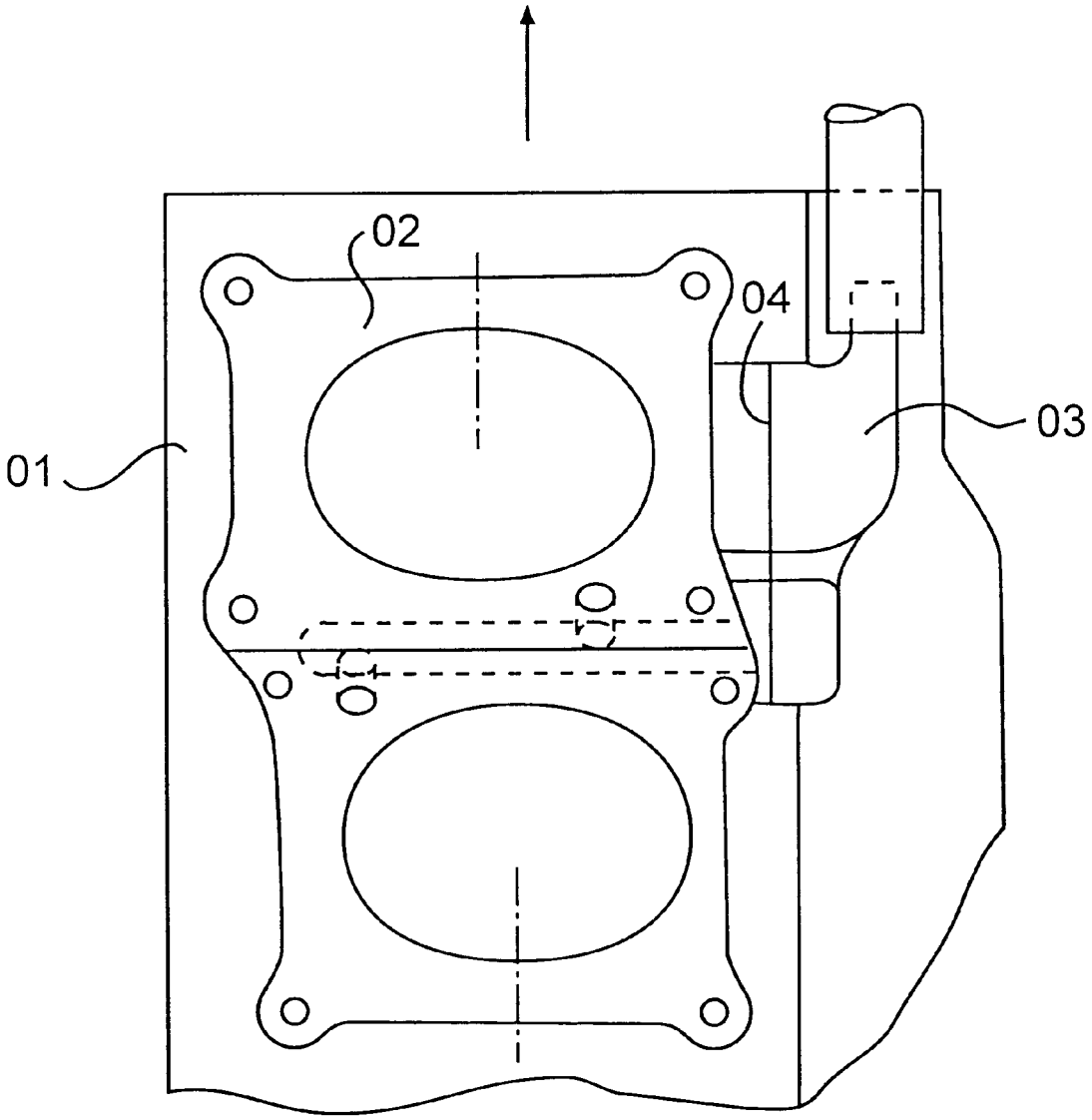
FIG. 8 CONVENTIONAL ART
FIG. 8 is a cross-sectional view taken along cross-section line VIII in FIG. 7.
Figure 9:
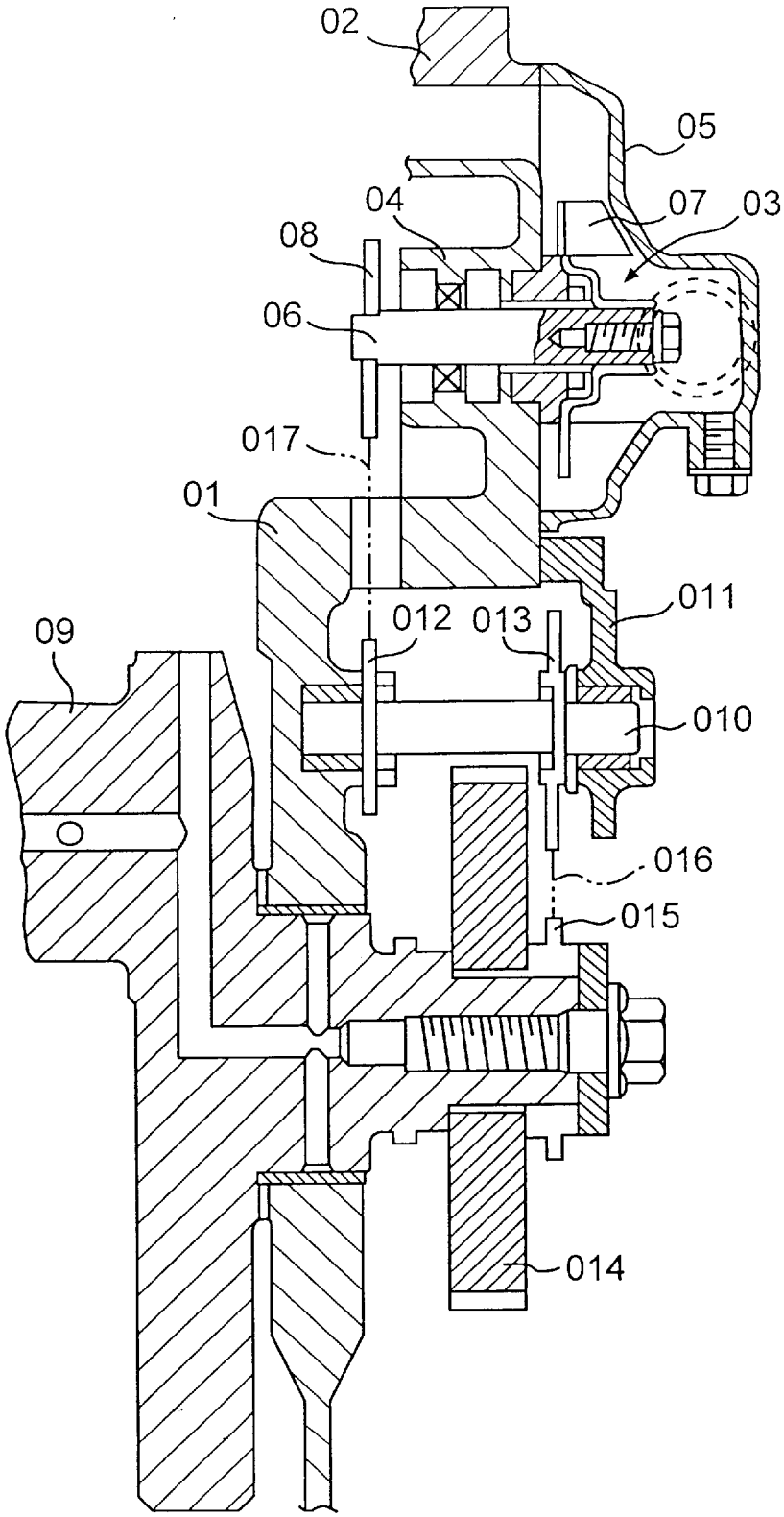
FIG. 9 CONVENTIONAL ART
FIG. 9 is a cross-sectional view taken along cross-section line IX—IX of FIG. 7.
Figure 10:
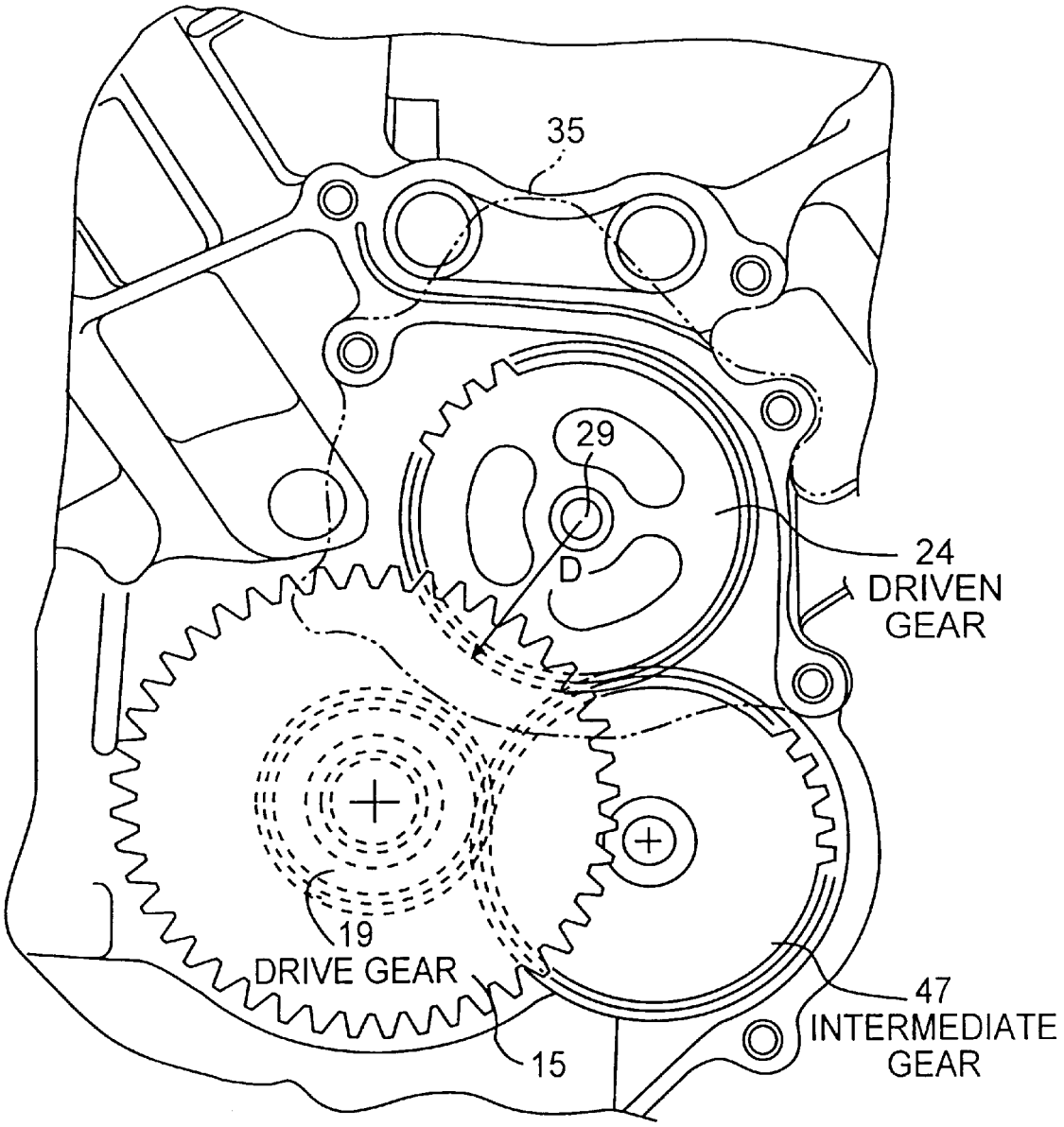
FIG. 10 is an enlarged view of FIG. 2 where a right side cover is removed and showing a gear transmission alternative.

As shown in FIG. 6, a water discharging part 37, is formed at the top part of the water jacket 47 that is formed in the cylinder block 11 and the cylinder head 12. One end of the water hose 38 is connected to the water discharging part 37 and the other end of the water hose 38 is connected to the water suction part 40 of the thermostat 39. The water discharging part 41 of the thermostat 39 is connected to the top part of the radiator 36 through a water hose 41a.

The water suction part 40 and the water discharging part 41 of the thermostat 39 are shut off as long as the water temperature is less than a predetermined temperature. Exceeding the predetermined temperature will cause the water suction part 40 and the water discharging part 41 of the thermostat 39 to communicate with each other.

In addition, a hot water cut-valve 42 (which is opened when the water temperature is less than a predetermined temperature and closed when the water temperature increases more than the predetermined temperature) is threadably fitted to the side wall of the thermostat 39. The other end of the hot water cut valve 42 is connected to an inlet of the jacket of the carburetor (not shown) through a hose 43. An outlet from the jacket of the carburetor is connected to a return port 44 of the side wall of the thermostat 39 through another hose 44*a*. Water heated by the water jacket 47 in the water-cooled 4-stroke internal combustion engine 1 is supplied to the jacket of the carburetor during a cold (low temperature) start to deice or otherwise prevent any frozen water in the carburetor.

In addition, as shown in FIG. 2, an oil pump 45 is mounted to a right side wall of the crank case 10. The oil pump 45 is connected to a clutch outer member (not shown) through a chain transmission mechanism 46 such that as the crank shaft 14 is rotated, the oil pump 45 is rotationally driven.

Since the preferred embodiment shown in FIGS. 1 to 6 is constructed as described above, when the water-cooled 4-stroke internal combustion engine 1 is running and the crank shaft 14 is being rotated, the water pump drive shaft 29 and the impeller 34 are rotationally driven through the water pump drive sprocket 19, the endless chain 33 and the water pump driven sprocket 24. The driven impeller 34 sucks the water in the radiator 36 into the water pump 27 and supplies water to the water jacket 47 of the cylinder block 11 and the cylinder head 12 and thereby cools the 4-stroke internal combustion engine 1 to a suitable temperature.

The water that has been heated within the water jacket 47 of the cylinder block 11 and the cylinder head 12 flows through the thermostat 39 and the water hose 38 to be recirculated to the radiator 36. In this way, when a cold engine 1 is started, the thermostat 39 is closed and the water within the cylinder block 11 and the cylinder head 12 is not supplied to the radiator 36 and thermal radiation of the water through the radiator 36 is terminated.

Also during a cold start of the engine 1, the hot water cut valve 42 is released to open and the heated water (which is heated up within the cylinder block 11 and the cylinder head 12) is supplied to the jacket of the carburetor (not shown) such that the icing effect within the carburetor (caused by gasification or atomization of the fuel) is prevented.

In this way, since the hot water cut valve 42 is directly fixed to the side wall of the thermostat 39, the number of component parts is substantially reduced which contributes to a light weight and cost efficient design.

In addition, because the pump drive shaft 29 is spline fitted to the splined aperture 25 of the water pump driven sprocket 24, a mere removal of the right side cover 26 from the cylinder block 11 (with the pump cover 35 still installed on the right side cover 26 and the endless-chain 33 still wound around the water pump drive sprocket 19 and the water pump driven sprocket 24) enables the pump drive shaft 29 to be pulled out of the splined aperture 25 of the water pump driven sprocket 24.

In other words, disassembling the water pump 27 is much easier than disassembling conventional water pumps such as water pump 03. The inventive water pump 27 may be disassembled merely by removing the right side cover 26 from the cylinder block 11 with the pump cover 35 still attached thereto to expose the pump drive shaft 29. Then, the pump drive shaft 29 with the impeller 34 mounted thereto can be simply pulled out from the splined aperture 25 of the water pump driven sprocket 24. The result is that repairing, inspecting and maintaining the water pump 27 can be performed quite easily and efficiently.

In addition, when the pump drive shaft 29 is pulled out of the shaft cylinder part 25, the water pump driven sprocket 24 is engaged with the output gear 15 due to the inboard mounting and relatively larger diameter of the water pump driven sprocket 24 and with respect to the output gear 15. The result is that the water pump driven sprocket (and integral splined aperture 25) does not drop from or otherwise fall off of the side wall of the cylinder block 11 during disassembly of the water pump 27.

Further, the pump drive shaft 29 that is spline fitted into the splined aperture 25 and the bearing 30 is spaced apart from the splined aperture 25 so that the pump drive shaft 29 and the impeller 34 do not oscillate when operated, but instead exhibit a stable rotating action.

Further, since the water pump 27 is installed at the cylinder block 11 while being spaced apart from the oil pump 45 arranged at the crank case 10, the flow passage length of the cooling system can be shortened. Thus, the load imposed on the water pump 27 is reduced and a small-sized water pump 27 can be realized.

In the preferred embodiment shown in FIGS. 1 to 6, although the water pump drive sprocket 19 integral with the crank shaft 14 and the water driven sprocket 24 spline fitted to the pump drive shaft 29 are connected by the endless chain 33, this chain transmission mechanism may be replaced with a gear transmission mechanism including drive gear 19, intermediate gear 47, and driven gear 24.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A structure for mounting a water pump to a water-cooled internal combustion engine, comprising:

a water pump following member rotatably mounted to a side wall of the internal combustion engine, a splined aperture mounted to said water pump following member, a water pump drive shaft removably spline fitted to said splined aperture of said water pump following member, an impeller mounted to said water pump drive shaft, and a water pump driving member mounted to the crank shaft of the internal combustion engine, said water pump driving member axially arranged closer to a center of the internal combustion engine than an output driving member mounted to the crank shaft, wherein said water pump following member is driven by accepting power from said water pump driving member, wherein power is transmitted from a crank shaft to the water pump through a transmission mechanism.

2. The structure for mounting a water pump to a water-cooled internal combustion engine according to claim 1, said water pump following member including a water pump driven sprocket, said water pump driving member including a water pump drive sprocket, wherein the transmission mechanism includes an intermediate gear which engages, directly or indirectly with said water pump drive sprocket and said water pump driven sprocket.

3. A structure for mounting a water pump to a water-cooled internal combustion engine, comprising:

a water pump following member rotatable mounted to a side wall of the internal combustion engine, a splined aperture mounted to said water pump following member, a water pump drive shaft removably spline fitted to said splined aperture of said water pump following member, and an impeller mounted to said water pump drive shaft, wherein power is transmitted from a crank shaft to the water pump through a transmission mechanism, wherein the transmission mechanism includes a chain, said water pump following member including a water pump driven sprocket, said water pump driving member including a water pump drive sprocket, said water pump drive sprocket axially arranged closer to a center of the internal combustion engine than an output gear mounted to the crank shaft, said water pump driven sprocket having a diameter projecting beyond a diameter of the output gear, wherein said water pump driven sprocket is driven by accepting power from said water pump drive sprocket via the chain.

4. A structure for mounting a water pump to a water-cooled internal combustion engine, comprising:

a water pump following member rotatable mounted to a side wall of the internal combustion engine, a splined aperture mounted to said water pump following member, a water pump drive shaft removably spline fitted to said splined aperture of said water pump following member, an impeller mounted to said water pump drive shaft, wherein power is transmitted from a crank shaft to the water pump through a transmission mechanism, a side cover removably mounted to a side of the internal combustion engine, and a water pump cover removably mounted to said side cover.

5. The structure for mounting a water pump to a water-cooled internal combustion engine according to claim 4, said side cover including a shaft supporting part rotatably supporting said water pump drive shaft.

6. The structure for mounting a water pump to a water-cooled internal combustion engine according to claim 5, further comprising:

a bearing provided between said shaft supporting part and said water pump drive shaft, a seal provided between said shaft supporting part and said water pump drive shaft.

7. A water pump for a water-cooled internal combustion engine, comprising:

a water pump following member rotatably mounted to a side wall of the internal combustion engine, a splined aperture mounted to said water pump following member, a water pump drive shaft removably spline fitted to said splined aperture of said water pump following member, an impeller mounted to said water pump drive shaft, a pump cover forming an inter-pump space which may be pumped by said impeller, and a water pump driving member mounted to the crank shaft of the internal combustion engine, said water pump driving member axially arranged closer to a center of the internal combustion engine than an output driving member mounted to the crank shaft, wherein power is transmitted from a crank shaft to the water pump through a transmission mechanism, wherein said water pump following member is driven by accepting power from said water pump driving member.

8. The water pump for a water-cooled internal combustion engine according to claim 7, said water pump following member including a water pump driven sprocket, said water pump driving member including a water pump drive sprocket, wherein the transmission mechanism includes an intermediate gear which engages, directly or indirectly, with said water pump drive sprocket and said water pump driven sprocket.

9. A water pump for a water-cooled internal combustion engine, comprising:

a water pump following member rotatable mounted to a side wall of the internal combustion engine, a splined aperture mounted to said water pump following member, a water pump drive shaft removably spline fitted to said splined aperture of said water pump following member, an impeller mounted to said water pump drive shaft, and a pump cover forming an inter-pump space which may be pumped by said impeller, wherein power is transmitted from a crank shaft to the water pump through a transmission mechanism, wherein the transmission mechanism includes a chain, said water pump following member including a water pump driven sprocket, said water pump driving member including a water pump drive sprocket, said water pump drive sprocket axially arranged closer to a center of the internal combustion engine than an output gear mounted to the crank shaft, said water pump driven sprocket having a diameter projecting beyond a diameter of the output gear, wherein said water pump driven sprocket is driven by accepting power from said water pump drive sprocket via the chain.

10. A structure for mounting a water pump to a water-cooled internal combustion engine, comprising:

a water pump following member rotatably mounted to a side wall of the internal combustion engine, a splined aperture mounted to said water pump following member, a water pump drive shaft removably spline fitted to said splined aperture of said water pump following member, an impeller mounted to said water pump drive shaft, a pump cover forming an inter-pump space which may be pumped by said impeller, and a side cover removably mounted to a side of said internal combustion engine, wherein power is transmitted from a crank shaft to the water pump through a transmission mechanism.

11. The water pump for a water-cooled internal combustion engine according to claim 10, said side cover including a shaft supporting part rotatably supporting said water pump drive shaft.

12. The water pump for a water-cooled internal combustion engine according to claim 11, further comprising:

a bearing provided between said shaft supporting part and said water pump drive shaft, and a seal provided between said shaft supporting part and said water pump drive shaft.

13. A structure for mounting a water pump to a water-cooled internal combustion engine, comprising:

a water pump following member rotatable mounted to a side wall of the internal combustion engine, a splined aperture mounted to said water pump following member, a water pump drive shaft removably spline fitted to said splined aperture of said water pump following member, an impeller mounted to said water pump drive shaft, wherein power is transmitted from a crank shaft to the water pump through a transmission mechanism, a radiator connected to said water pump, a water jacket provided in a crank case and a cylinder block of the internal combustion engine, said water jacket connected to said water pump, said water pump circulating water in the cooling system to cool the internal combustion engine, a thermostat mounted to a side wall of the internal combustion engine a water discharging part formed at a top part of the water jacket, a first hose connecting said water discharging part with a suction part of said thermostat, and a second hose connecting said radiator with a water discharging part of said thermostat, wherein the water suction part and the water discharging part of said thermostat are shut off as long as the water temperature is less than a predetermined temperature.

14. The cooling system according to claim 13, further comprising:

a hot water cut-valve mounted to a side wall of the thermostat, a third hose connecting said hot water cut-valve with an inlet of a carburetor jacket, and a fourth hose connecting an outlet of the carburetor jacket with the suction part of said thermostat, wherein said hot water cut-valve is opened when the water temperature is less than a predetermined temperature and closed when the water temperature exceeds the predetermined temperature to de-ice the carburetor.

* * * * *